US006922182B2

(12) United States Patent
Sase

(10) Patent No.: US 6,922,182 B2
(45) Date of Patent: Jul. 26, 2005

(54) DISPLAY DEVICE DRIVE CIRCUIT

(75) Inventor: Ichiro Sase, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 314 days.

(21) Appl. No.: 10/300,847

(22) Filed: Nov. 21, 2002

(65) Prior Publication Data

US 2003/0122808 A1 Jul. 3, 2003

(30) Foreign Application Priority Data

Dec. 28, 2001 (JP) ..... 2001-401069

(51) Int. Cl.[7] ..... G09G 3/30
(52) U.S. Cl. ..... 345/76; 345/204
(58) Field of Search ..... 345/76–81, 82–83, 345/90, 100, 204; 315/169.1, 169.2, 169.4

(56) References Cited

U.S. PATENT DOCUMENTS 4,967,192 A * 10/1990 Hirane et al. ..... 345/211
4,996,523 A * 2/1991 Bell et al. ..... 345/77
5,289,112 A 2/1994 Brown et al.
5,325,107 A * 6/1994 Ogawa et al. ..... 345/79
6,369,783 B1 * 4/2002 Kwon et al. ..... 345/75.2
6,496,168 B1 * 12/2002 Tomida ..... 345/76
2004/0036512 A1 * 2/2004 Takeuchi ..... 327/112

FOREIGN PATENT DOCUMENTS

JP 6-204564 7/1994

* cited by examiner

*Primary Examiner*—Bipin Shalwala
*Assistant Examiner*—Mansour M. Said
(74) *Attorney, Agent, or Firm*—Volentine Francos & Whitt, PLLC

(57) ABSTRACT

A display device drive circuit that enables high-precision fine-tuning of the drive currents. In this drive circuit, a plurality of current supply transistors are connected in parallel to each data line. A switching transistor is connected in series with each current supply transistor. When the switching transistors are ON, the drive currents from the corresponding current supply transistors are supplied to the data line. The magnitude of the drive current supplied to the data line is controlled by the number of switching transistors that are ON simultaneously. Consequently, when compared to a case in which the magnitude of the drive current is controlled by the gate potential on the current supply transistors, it is possible to perform precision control of the drive current values.

17 Claims, 5 Drawing Sheets

DISPLAY DEVICE DRIVE CIRCUIT

BACKGROUND OF THE INVENTION

1. Field of the Invention

The present invention relates to a display device drive circuit. The drive circuit in accordance with the present invention is mounted in a display device that uses light-emitting elements. The light-emitting elements used in the display device are, for example, organic electroluminescent (EL) elements or light-emitting diodes.

2. Description of Related Art

In recent years, display devices using light-emitting elements have been put into practical application. Organic EL elements, light-emitting diodes, and so on, are well-known examples of these light-emitting elements.

Organic EL elements can drive display devices at low DC voltages. Additionally, when compared to light-transmitting type elements, such as liquid crystal elements, organic EL elements provide a broader field of view, a brighter display surface, thinner form and lighter body. Because of this, organic EL elements can be used in large-capacity display devices for various applications.

Organic EL display devices are provided with a large number of organic EL elements arranged in a matrix. The anodes of the organic EL elements in the same column are all connected to the same data line. Additionally, the cathodes of the organic EL elements in the same row are all connected to the same scan line. Transistors for supplying the drive current are connected to each data line. The magnitude of the drive current in normal display devices is controlled by the voltage between the gates and sources of these transistors.

The brightness of the light emitted from an organic EL element depends on the drive current. Consequently, the drive currents supplied to the various data lines must be adjusted in order to improve the image quality of the organic EL display devices. For example, drive currents are set to large values for large display units. Moreover, in order to compensate for manufacturing variability such as variability in the resistor in the interconnections in the peripheral circuitry, it may also be necessary to adjust the drive currents for each individual device.

As described above, the magnitude of the drive current is controlled by the voltage across the gate and source of the electric current supply transistor. However, the characteristics of the transistor vary in accordance with the voltage between the gate and the source. As a result, it is not easy to adjust the drive current with precision for each device.

SUMMARY OF THE INVENTION

An object of this invention is to provide a display device drive circuit wherein precise adjustments of the drive currents are possible.

To this end, the display device drive circuit according to the present invention comprises: first transistors, provided in parallel in a plurality for each data line in order to supply drive currents in accordance with the control potential to the data lines of the display panel; second transistors provided for each first transistor in order to switch between supply/non-supply of the drive current to the data line; a potential generating circuit for supplying a uniform control potential to the first transistors; and a signal generating circuit that controls the number of the second transistors that are in an ON state to thereby control the value of the drive currents supplied to the data lines.

According to this invention, the magnitude of the drive current that is supplied to the data lines is controlled by the number of second transistors that are simultaneously in an ON state. Consequently, it is possible to achieve a higher precision of control of the drive current as compared to the case wherein the magnitude of the drive current is controlled by the control potential of the first transistors.

BRIEF DESCRIPTION OF THE DRAWINGS

The other objects and benefits of the present invention will be explained below with reference to the attached drawings.

DESCRIPTION OF THE PREFERRED EMBODIMENTS

Figure 1:
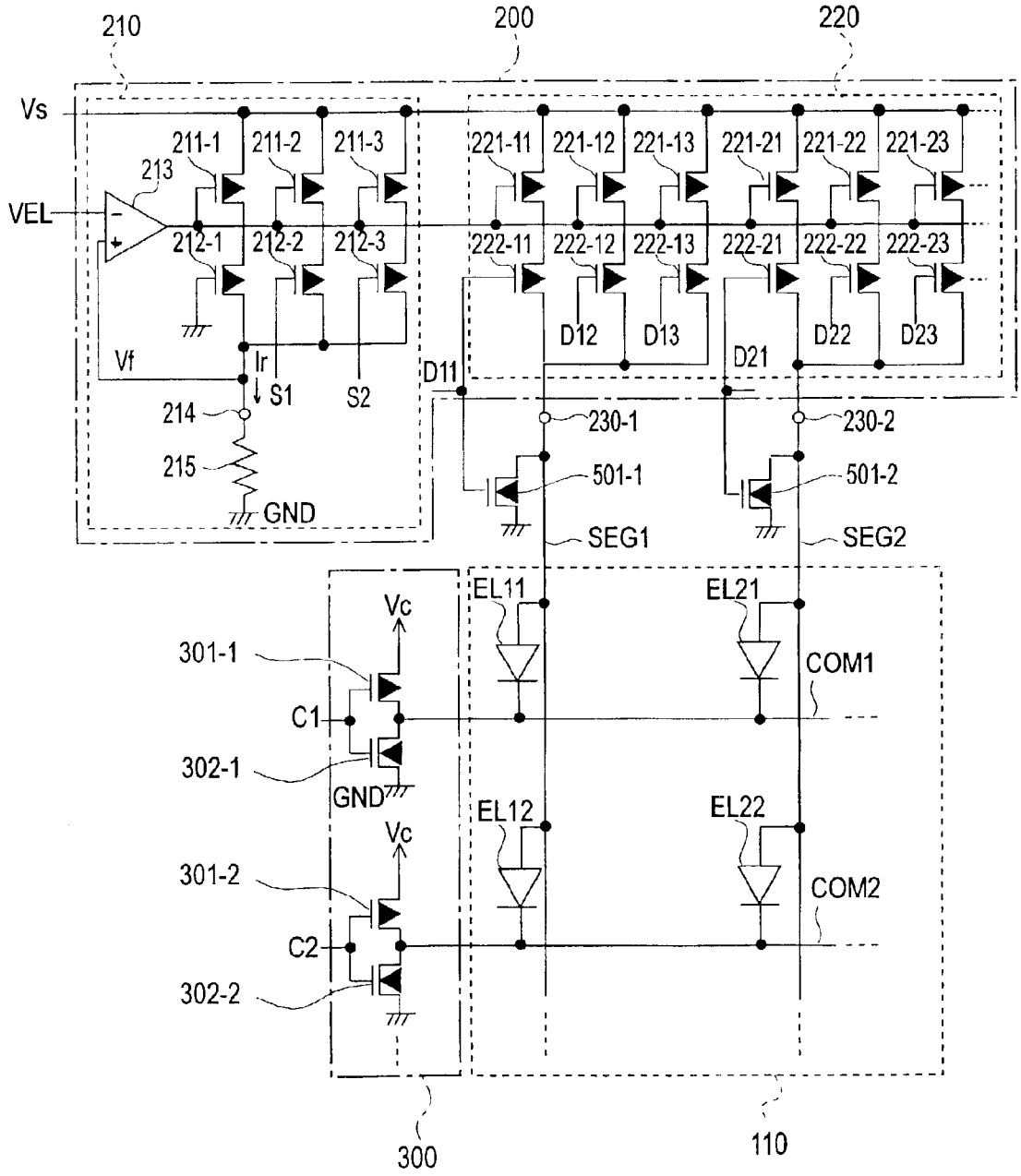
FIGS. 1 and 2 are circuit diagrams showing the constitution of a display device according to a first embodiment.

Embodiment of the present invention will be explained below using the drawings. In the drawings, the sizes of the various constitutional components, their shapes, and their relative positioning are shown only schematically in order to provide a better understanding of the present invention, and furthermore, any quantitative conditions in the explanations below are merely examples.

First Embodiment

Figure 2:
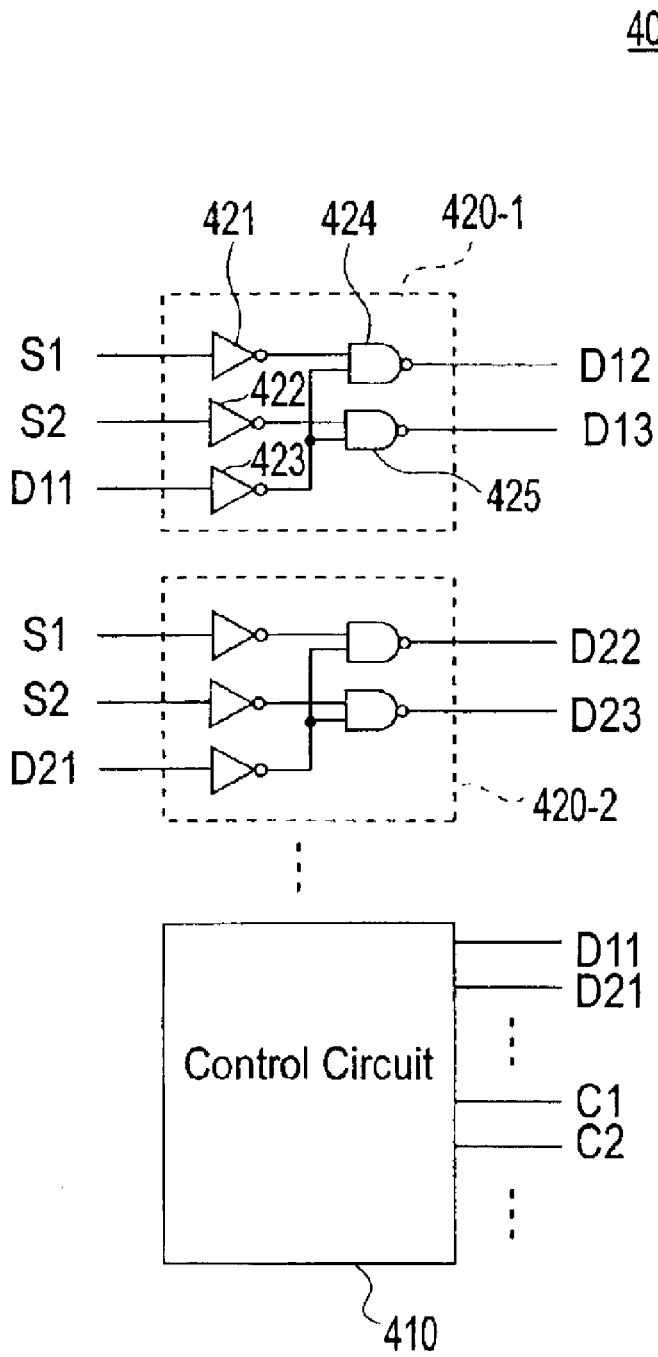

FIGS. 1 and 2 are circuit diagrams showing the schematic constitution of an organic EL display device according to the first embodiment.

The display device according to the present embodiment comprises a display panel 110 and a drive circuit. The drive circuit comprises a data line drive circuit 200, a scan line drive circuit 300, and a signal generating circuit 400. Furthermore, nMOS transistors 501-1, 501-2, . . . are connected to the data line drive circuit 200.

The display panel 110 comprises a plurality of organic EL elements EL11 to Elmn, arranged in the form of a matrix. The organic EL elements in the same column are all commonly connected to the respective data line SEG1 to SEGm. The organic EL elements in the same row are all commonly connected to the respective scan lines COM1 to COMn.

The data line drive circuit 200 comprises a constant current circuit 210 and an output circuit 220. The constant current circuit 210 comprises current supply pMOS transistors 211-1, 211-2, and 211-3, switching pMOS transistors 212-1, 212-2, and 212-3, an operational amplifier 213, a resistor connection terminal 214, and an external resistor 215. The operational amplifier 213 has input thereto the voltage signal VEL at the −input terminal, and a reference voltage Vf is input thereto at the +input terminal. The output terminal of the operational amplifier 213 is connected to the gates of the pMOS transistors 211-1 to 211-3. The sources of the pMOS transistors 211-1 to 211-3 are connected to a power supply line Vs. The drains of the pMOS transistors 211-1 to 211-3 are connected to the sources of the pMOS transistors 212-1 to 212-3. The drains of the pMOS transistors 212-1 to 212-3 are connected to the resistor connection terminal 214. Furthermore, the gate of the pMOS transistor 212-1 is connected to a ground line GND, the gate of the pMOS transistor 212-2 has input thereto a switching signal S1, and the gate of the pMOS transistor 212-3 has input thereto a switching signal S2. In this embodiment, the current supply pMOS transistors 211-1 to 211-3 all have practically identical transistor characteristics, and the switching pMOS transistors 212-1 to 212-3 all have practically identical transistor characteristics. The resistor connection terminal 214 is connected to the ground line GND via the resistor 215. The resistor 215 uses the voltage drop from the current Ir supplied from the pMOS transistors 212-1 to 212-3 to generate the reference voltage Vf.

The output circuit 220 is provided with current supply pMOS transistors in a quantity equal to 3×m and switching pMOS transistors in a quantity equal to 3×m. Here, 'm' is a number of data line. The transistor characteristics of the current supply pMOS transistors 221-11 to 221-m3 are practically identical to the transistor characteristics of the current supply pMOS transistors 211-1 to 211-3 in the constant current circuit 210. Additionally, the transistor characteristics of the switching pMOS transistors 222-11 to 222-m3 are practically identical to the transistor characteristics of the current supply pMOS transistors 212-1 to 212-3 within the constant current circuit 210. The gates of the pMOS transistors 221-11 to 221-m3 are connected to the output terminal of the operational amplifier 213. The sources of the pMOS transistors 221-11 to 221-m3 are each connected to the power supply line Vs. Furthermore, the drains of the pMOS transistors 221-11 to 221-m3 are connected to the sources of the pMOS transistors 222-11 to 222-m3. Here the drains of the pMOS transistors 222-11, 222-12 and 222-13 are connected to the data line SEG1 via the output terminal 230-1. Additionally, the drains of the pMOS transistors 222-21, 222-22, and 222-23 are connected to the data line SEG2 via the output terminal 230-2. In other words, each data line SEG1 to SEGm is connected to the drains of the three switching pMOS transistors respectively via the output terminals 230-1 to 230-m. The mutually differing select signals D11 to Dm3 are inputted into the gates of the pMOS transistors 222-11 to 222-3m. The sources of the corresponding nMOS transistors 501-1, 501-2, . . . , 501-m are respectively connected to the data lines SEG1 to SEGm. The drains of the nMOS transistors 501-1 to 501-m are connected to the ground line GND. Additionally, the gates of the nMOS transistors 501-1 to 501-m have input thereto the same data line select signals D11 to Dm1 as the corresponding switching transistors 222-11, 222-21, . . . 222-m1. These nMOS transistors 501-1 to 501-m are used for discharging data lines SEG1 to SEGm which are not selected.

The scan line drive circuit 300 comprises pMOS transistors 301-1, 301-2, . . . 301-n, and nMOS transistors 302-1, 302-2, . . . 302-n. In other words, numbers of pMOS transistors and nMOS transistors are respectively equal to a number of scan lines. As is shown in FIG. 1, these pMOS transistors and nMQS transistors comprise n units of inverters. The input terminal of each inverter has input thereto a scan line select signal C1 to Cn. The inverted value of the scan line select signals C1 to Cn is supplied from the output terminal of each inverter to the scan lines COM1 to COMn.

The signal generating circuit 400 comprises a control signal generating circuit 410 and switching signal generating circuits 420-1 to 420-m. The control signal generating circuit 410 generates select signals D11, D21, . . . Dm1 and C1, C2, . . . Cn. The switching signal generator circuits 420-1 to 420-m use the switching signals S1 and S2 inputted from the outside, and the data line select signals D11 to Dm1, inputted from the control signal generating circuit 410 to produce the select signals D12, D22, . . . Dm2 and select signals D13, D23, . . . Dm3. As is shown in FIG. 2, each switching signal generating circuit 420-1 to 420-m comprises inverters 421, 422, and 423, and NAND gates 424 and 425. The NAND gate 424 has input thereto the switching signal S1 via the inverter 421, and has input thereto the data line select signal D11 via the inverter 423. In addition, the NAND gate 425 has input thereto the switching signal S2 via the inverter 422, and has input thereto the data line select signal D11 via the inverter 423. Consequently, the NAND gates 424 and 425 output the switching signals S1 and S2 without change as the select signals D12 and D13 when the data line select signal D11 is low, and, when the data line select signal D11 is high, the NAND gates 424 and 425 output a high level as the select signals D12 and D13. That is, gates 421, 423 and 424 calculate a logical sum of signals S1 and D11, moreover, gates 422, 423 and 425 calculate a logical sum of signals S2 and D11. The constitution of the other switching generator circuits 420-2 to 420-m are the same as the constitution for the switching signal generator circuit 420-1.

The operation of the organic EL display device will be explained below.

In the display device according to the present embodiment, the drive currents that are supplied to the data lines SEG1 to SEGm are set by the resistance value R of the resistor 215 or by the voltage signal VEL. Additionally, the values for the switching signals S1 and S2 are modified according to the magnitude of the drive currents. Switching signals S1 and S2 are inputted into the gates of the switching pMOS transistors 212-2 and 212-3, and into the switching signal generating circuits 420-1 to 420-m.

First, a case where the switching signals S1 and S2 are both set at high level will be explained. The switching signals S1 and S2 are set at high level when the drive current is at a minimum. Here, an example in which the VEL is set at 6 volts and the resistance R is set at 30 k Ω will be used in explanation. In this case, the drive current, Ir, is 200 μAmp.

When the switching signals S1 and S2 are both at high level, the switching pMOS transistors 212-2 and 212-3 are both off. As a result, current is not flow through the current supply pMOS transistors 211-2 and 211-3. Additionally, when the switching signals S1 and S2 are at high level, the select signals D12, D13 . . . Dm3 produced at the switching signal generating circuits 421-1 to 420-m are all at high level, regardless of the values of the data line select signals D11, D21, . . . Dm1 generated by the control circuit 410. As a result, the switching pMOS transistors 222-12, 222-13, . . . 222-m2, 222-m3 of the output circuit 220 are off.

The voltage signal VEL, that is, 6 volts, is inputted into the constant current circuit 210. The operational amplifier 213 compares the voltage signal VEL and the reference voltage Vf. If the voltage Vf is lower than the voltage VEL, then the operational amplifier 213 reduces the output voltage, and if the voltage Vf is higher than the voltage VEL, then the operational amplifier 213 increases the output voltage. If the output voltage of the operational amplifier 213 decreases, then the current flowing through the pMOS transistor 211-1 increases, thereby increasing the voltage Vf. Conversely, if the output voltage of the operational amplifier 213 increases, the current flowing through the pMOS transistor 211-1 falls, and so the voltage Vf falls. Thus, the reference voltage Vf becomes the same value as the voltage VEL. When Vf and VEL match, the current Ir flowing through the resistor 215 is equal to VEL/R. When R is 30 k Ω and VEL is 6V, Ir is 200 μA. In this case, the current passing through the pMOS transistors 211-1 and 212-1 is also 200 μA.

The output voltage of the operational amplifier 213 is supplied to the output circuit 220. This causes the current supply pMOS transistors 221-11 to 221-m3 to all turn on.

The control circuit 410 outputs the data line select signals D11, D21,. . Dm1 and the scan line select signals C1, C2, . . . Cn. These select signals select the organic EL elements that will emit light. An example in which the select signal D11 is at low level and the select signal C1 is at high level, and the other select signals D21 to Dm1 are all at high level and C2 to Cn are all at low level, will be used in the following explanation.

As described above, the switching signals S1 and S2 are at high level, so the select signals D12, D13, D22, . . . that are generated in the switching signal generating circuit 420-1 to 420-2 are all at high level. As a result, the switching transistors 222-12, 222-13, 222-22, . . . , into which the select signals are inputted from their gates, are off. In addition, because the data line select signal D11 is at low level, the pMOS transistor 222-11 turns on and the nMOS transistor 501-1 turns off. On the other hand, the data line select signals D21, D31, . . . , Dm1 are all at high level, and so the pMOS transistors 222-21, 222-31, . . . , 222-m1 all turn off and the nMOS transistors 501-2, 501-3, . . . , 501-m turn on. As a result, the data line SEG1 is supplied with a current Ir, but the current Ir is not supplied to the other data lines SEG2 to SEGm. Also, as described above, the scan line select signal C1 is at high level, but the other scan line select signals C2 to Cn are at low level. Consequently, the scan line COM1 is connected to the ground line GND, while the other scan lines COM2 to COMn are connected to the power supply line Vc. Thus, a forward bias voltage is applied to the organic EL element EL11, while either a reverse bias voltage or a 0 voltage is applied to the other organic EL elements. Consequently, the organic EL element EL11 is the only one that emits light.

As described above, the transistor characteristics of the pMOS transistor 221-11 are practically identical to the transistor characteristics of the pMOS transistor 211-1, and the transistor characteristics of the pMOS transistor 222-11 are practically identical to the transistor characteristics of the transistor 212-1. Consequently, the value of the current passing through the data line SEG1 is Ir.

The data lines and scan lines that can be selected simultaneously can each be either a single line or a plurality of lines. When a plurality of data lines are selected simultaneously, then the value of the current passing through each data line is Ir.

The operation of the display device will be explained next for a case in which the switching signal S1 is set at low level and the switching signal S2 is set at high level.

When doubling the drive current, or in other words, when modifying the drive current to 400 $\mu$A, the switching signal S1 is set at low level and the switching signal S2 is set at high level. The drive current is doubled by cutting the resistance value R of the resistor 215 in half, or in other words, by modifying the resistance value R to 15 kΩ. The drive current can also be doubled by doubling the voltage signal VEL, or in other words, setting the voltage signal VEL to 12 volts, without modifying the resistance value R.

When the switching signal S1 is modified to the low level, the pMOS transistor 212-2 turns on. On the other hand, the switching signal S2 is at high level, so the pMOS transistor 212-3 is off. Next, the voltage signal VEL is inputted into the operational amplifier 213. The same operations as in the case described above, where both switching signals S1 and S2 are at high level, cause the voltage Vf to go to the same value as the voltage signal VEL. When this occurs, the current Ir passing through the resistor 215 goes to 400 $\mu$A. Here, the gate voltages of the current supply pMOS transistors 211-1 and 211-2 are the same. As a result, the same current value flows through the pMOS transistors 211-1 and 211-2. The current Ir passing through the resistor 215 is the sum of the currents flowing these transistors 211-1 and 211-2. As a result, the current passing through the pMOS transistors 211-1 and 211-2 are each 200 $\mu$A.

The output of the operational amplifier 213 is supplied to the output circuit 220. This causes all of the current supply pMOS transistors 221-11 to 221-m3 to turn on.

The control circuit 410 outputs the data line select signals D11, D21, . . . , Dm1, and the scan line select signals C1, C2, . . . , Cn. A case in which the select signal D11 is at low level and the select signal C1 is at high level, and other select signals D21 to Dm1 are all at high level and C2 to Cn are at low level, will be used as an example in the explanation below.

since the switching signal S1 is at low level and the switching signal S2 is at high level, the switching signal generating circuit 420-1 outputs a low-level potential as the select signal D12, and outputs a high-level potential as the select signal D13. On the other hand, because the data line select signals D21 to Dm1 are all at high level, the select signals D22, D23, . . . generated by the other switching signal generating circuits 420-2 to 420n are all at high level. As a result, of the output circuit 220 switching pMOS transistors, transistors 222-11 and 222-12 are on, and the other switching pMOS transistors 222-13 to 222-m3 are all off. Additionally, the nMOS transistor 501-1 turns off, and the other nMOS transistors 501-2 to 501-m turn on.

The same current values as in the pMOS transistors 212-1 and 212-2 pass through the pMOS transistors 222-11 and 222-12 respectively. Consequently the current values in pMOS transistors 222-11 and 222-12 are both 200 $\mu$A. Therefore, the current passing through the data line SEG1 is Ir, or in other words, 400 $\mu$A.

Next, the operation of the display device 100 will be explained for a case in which the switching signals S1 and S2 are both set at low level.

The switching signals S1 and S2 are both set at low level when the drive current is tripled, that is, modified to 600 $\mu$A. The drive current is tripled by modifying the resistance value R of the resistor 215 to one third of what it was, that is, to 10 kΩ. The drive current can also be tripled by tripling the voltage signal VEL, that is, modifying it to 18V, while leaving the resistance value R unchanged.

When the switching values S1 and S2 are at low level, the pMOS transistors 212-2 and 212-3 turn on. The voltage signal VEL is supplied to the operational amplifier 213. In doing so, the current Ir that passes through the resistor 215 goes to 600 $\mu$A. Here, the gate voltages of the current supply pMOS transistors 212-1, 212-2, and 212-3 are all the same. Consequently, the current values in the pMOS transistors 212-1, 212-2 and 212-3 are identical. The current Ir that passes through the resistor 215 becomes the sum of the currents that pass through these transistors 212-1, 212-2, 212-3. Consequently, the currents that flow through the pMOS transistors 212-1, 212-2, and 212-3 all go to 200 $\mu$A.

The output of the operational amplifier 213 is supplied to the output circuit 220. In so doing, the current supply pMOS transistors 221-11 to 221-m3 are all turned on.

The control circuit 410 outputs the data line select signals D11, D21, . . , Dm1, and the scan line select signals C1, C2, . . . Cn. A case in which the select signal D11 is at low level and the select signal C1 is at high level, and the other select signals D21 to Dm1 are at high level and C2 to Cn are at low level, will be used as an example in the explanation below.

Since the switching signals S1 and S2 are at low level, the switching signal generating circuit 420-1 outputs low level potentials for the select signals D12 and D13. On the other hand, because the data line select signals C21 to Dm1 are all at high level, the select signals D22, D23, . . . generated by the other switching signal generating circuits 420-2 to 420-n are all at high level. Consequently, of the output circuit 420 switching pMOS transistors, transistors 222-11, 222-12, and 222-13 turn on, while the other switching pMOS transistors 222-21 to 222-m3 all turn off. Additionally, the nMOS transistor 501-1 turns off and the other nMOS transistors 501-2 to 501-m turn on.

The same current value as in pMOS transistors 212-1, 212-2, and 212-3 pass through the pMOS transistors 222-11, 222-12, and 222-13, respectively. Consequently, the current values in the pMOS transistors 222-11, 222-12, and 222-13 are each 200 $\mu$A. Because of this, the current that passes through the data line SEG1 is Ir, that is, 600 $\mu$A.

In the display device 100 of the present embodiment it is possible to adjust the drive currents at a high level of precision for the reasons explained below.

Figure 3:
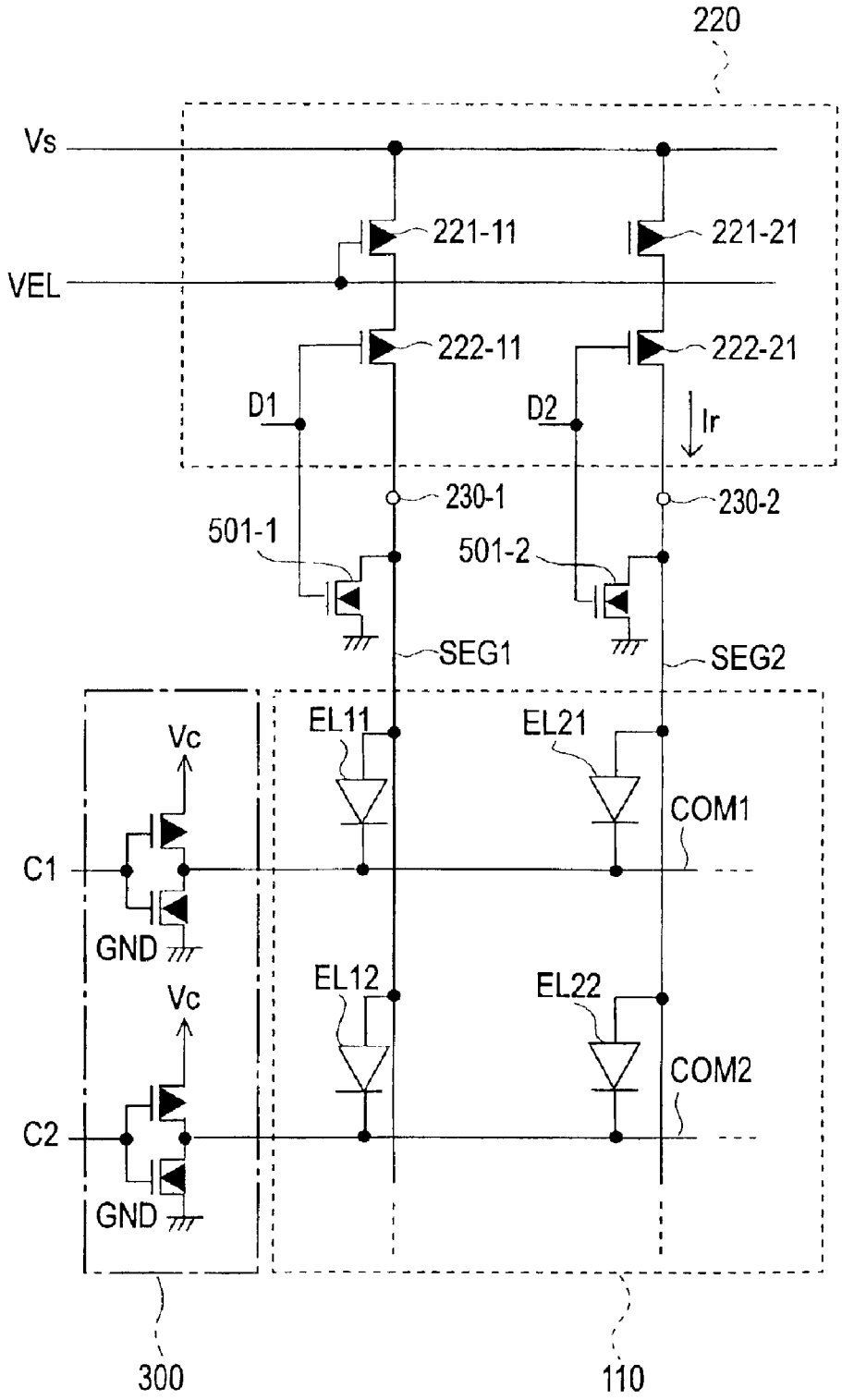
FIG. 3 is a circuit diagram of a display device in contrast to the display device drive circuit according to the first embodiment.

FIG. 3 is a circuit diagram showing a display device for comparison. The display device in FIG. 3 is not included in the present invention, nor is it prior art. In FIG. 3 the structural elements that are marked with the same notations as in FIG. 1 show the same elements as in FIG. 1.

The device in FIG. 3 is equipped with only a single current supply pMOS transistor and a single switching pMOS transistor for each data line SEG1 to SEGm. In the device of FIG. 3, the gate potential VEL of the current supply pMOS transistors 221-11, 221-21, . . . , 221-m1 can be modified in order to adjust the value of the current supplied to the data lines SEG1 to SEGm. However, the transistor characteristics are not changed simply by adjusting the current Ir by modifying the gate potential.

Figure 4:
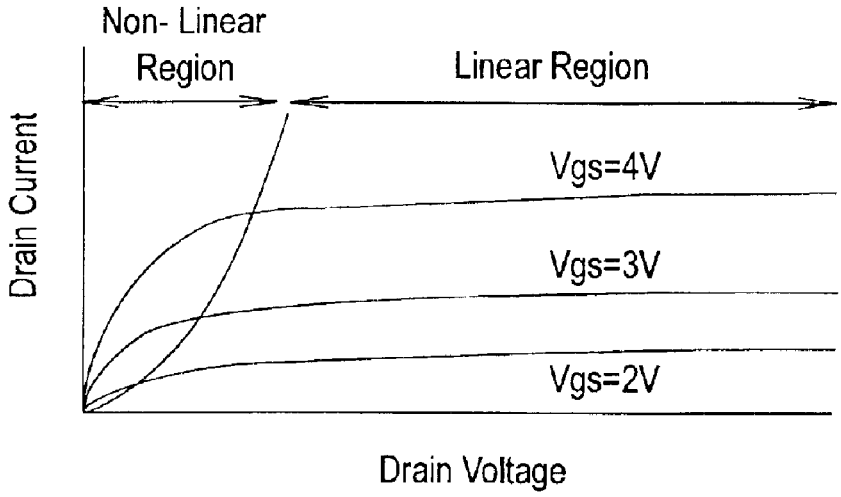
FIG. 4 is a graph for explaining the operation of the display device drive circuit according to the first embodiment.

FIG. 4 is a graph showing the relationship between the drain voltage Vds and the drain current Ids. As is shown in FIG. 4, when the transistor gate voltage Vgs is altered, the drain current Ids changes. The graph in FIG. 4 has a non-linear region, that is, a region in which the current Ids is highly dependent on the voltage Vds, and a linear region, that is, a region in which the current Ids largely independent of the voltage Vds. The position of the threshold point between the non-linear region and the linear region changes depending on the gate voltage Vgs. Because of this, when the drain current Ids is controlled by the gate voltage Vgs, it is extremely difficult to control with precision the drain current Ids. Thus, by raising the drain voltage Vds sufficiently, it becomes possible to control the drain current Ids with precision. However, the higher the drain voltage Vds, the higher the power consumption, that is, the greater the product of Vds×Ids.

In contrast, in the display device according to the present embodiment, the drive current value is controlled by the number of current supply pMOS transistors used rather than by the gate voltage. In addition, the value of the current passing through each of the current supply pMOS transistors is the same regardless of the drive current value. Consequently, the display according to the present embodiment is able to control the drive current with precision and with low power consumption.

Figure 5:
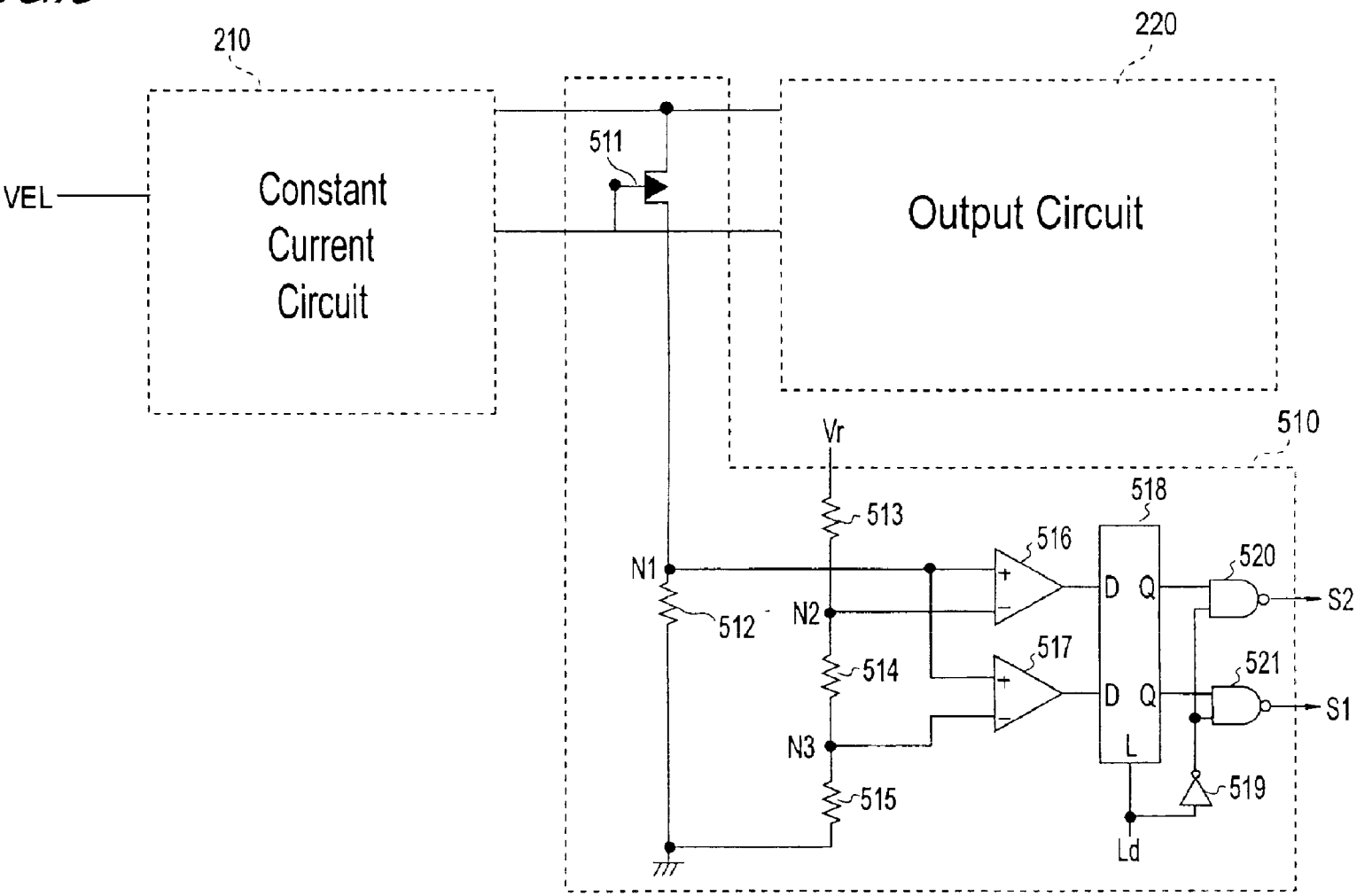
FIG. 5 is a circuit diagram showing the constitution of a display device drive circuit according to a second embodiment.

FIG. 5 is a circuit diagram showing the schematic constitution of an organic EL display device according to a second embodiment. In FIG. 5, the constitutional elements having the same notations as those in FIG. 1 are each the same structural elements as in FIG. 1.

The display device according to the present embodiment differs from the display device according to the first embodiment in that it is equipped with a current detector circuit 510. The current detector circuit 510 is a circuit for generating the switching signals S1 and S2 automatically.

As is shown in FIG. 5, the current detection circuit 510 comprises a pMOS transistor 511, resistors 512 to 515, voltage comparators 516 and 517, a latch circuit 518, an inverter 519, and NAND gates 520 and 521.

The source of the pMOS transistor 511 is connected to the power supply line Vs, the gate of the pMOS transistor 511 is connected to the output terminal of constant current circuit 210 (i.e. the output terminal of the operational amplifier 213 shown in FIG. 1), and the drain of the pMOS transistor 511 is connected to a node N1. The resistor 512 is connected at one end to the node N1 and at the other end to the ground line GND. One end of the resistor 513 inputs a reference potential Vr, and the other end is connected to the node N2. The reference potential Vr is generated by a circuit not shown in the diagram. The resistor 514 is connected at one end to the node N2, and at the other end to the node N3. The resistor 515 is connected at one end to the node N3 and at the other end to the ground line GND. The voltage comparator 516 is connected to the node N1 at the +terminal, and connected to the node N2 at the −terminal. The voltage comparator 517 is connected to the node N1 at the +terminal and to node N3 at the −terminal. The latch circuit 518 has input thereto the output values of the voltage comparators 516 and 517 at the D1 and D2 terminals when the load signal Ld is at high level, and outputs the latched signal values from the Q1 and C2 terminals. The inverter 519 has input thereto the load signal Ld and outputs an inverted value. One input terminal of the NAND gate 520 is connected to the Q1 terminal of the latch circuit 518, and the other input terminal thereof is connected to the output terminal of the inverter 519 and the NAND gate 520 outputs the switching signal S2 from the output terminal. One input terminal of the NAND gate 521 is connected to the Q2 terminal of the latch circuit 518, and the other input terminal thereof is connected to the output terminal of the inverter 519, and the NAND gate 521 outputs the switching signal S1 from the output terminal.

The operation of the display device will be explained below.

One of the ends of the resistor 513 is supplied with a reference potential Vr from a circuit not shown in the diagram. This reference potential Vr undergoes voltage division by the resistors 513, 514, and 515. In other words, the potential V2 at the node N2 is higher than the potential V3 at the node N3. The potentials V2 and V3 are determined by the reference potential Vr and the resistance values of the resistors 513, 514 and 515.

When the current Ir is first generated by the constant current circuit 210, a current with the same value as the current Ir is supplied to some or all of the data lines SEG1 to SEGm. At this time, the pMOS transistor 511 carries a current that is of the same value as the current Ir. This current passes to the ground line GND through the resistor 512. Since a voltage drop is generated in this resistor 512, the potential V1 of the node N1 varies depending on the current that passes through the pMOS transistor 511. The voltage comparator 516 outputs a high level when the potential V1 at node N1 is higher than, or the same as, the potential V2 at the node N2, and outputs a low level if the voltage V1 is lower than the potential V2. Additionally, the voltage comparator 517 outputs a high level when the potential V1 is higher than, or equal to, the potential V3 at the node N3, and outputs a low level if the potential V1 is lower than the potential V3. The latch circuit 518 latches the output signals of the voltage comparators 516 and 517. The latched signals are inverted by the NAND gates 520 and 521 when the load signal Ld is at low level and are outputted as the switching signals S1 and S2. These switching signals S1 and S2 are sent to the switching signal generating circuits 420-1 to 420-m and to the constant current circuit 210, as in the first embodiment.

Consequently, when V1>V2>v3 or V1=V2>v3, the switching signals S1 and S2 go to a low level, when V2>V1>V3 or V2>V1=V3, only the switching signal S1 goes to a low level, and if V3>V2>V1, then the both switching signals S1 and S2 go to a high level.

The operations of the other circuits 110, 200, 300, and 400 are the same as in the display device according to the first embodiment.

In the first and second embodiments the constant current circuits 210 and the output circuit 220 are constituted from pMOS transistors. However, these circuits 210 and 220 can also be constituted from nMOS transistors. Furthermore, the various circuits 200 to 400 can be constituted from bipolar transistors rather than from MOS transistors.

In the first and second embodiments, the display panel 110 comprises organic EL elements. However, the present invention can also be applied to a display panel constituted from other types of light-emitting elements.

What is claimed is:

1. A display device drive circuit comprising:

first transistors, provided in parallel in a plurality for each data line in order to provide to the data lines of a display panel drive currents in accordance with a control potential;

second transistors provided for each of said first transistors in order to switch the drive currents for said data lines between a supplied state and a non-supplied state;

a potential generating circuit for supplying an identical control potential to said first transistors; and a signal generating circuit that controls a value of the drive currents supplied to said data lines by controlling a number of said second transistors that are in an ON state, said potential generating circuit having a constant current circuit that generates an output potential from a voltage drop when a predetermined current is supplied to a reference resistor, and said constant current circuit comprising a plurality of third transistors provided in parallel in order to supply to said reference resistor an electric current according to the control potential, a plurality of fourth transistors provided for each of said third transistors in order to switch the electric currents provided to said reference resistor between a supplied state and a non-supplied state, and an operational amplifier that outputs, to control terminals of said third transistors, the control potential depending on a difference between the output potential obtained from the voltage drop of said reference resistor and a value of an externally provided voltage signal.

2. The display device drive circuit according to claim 1, wherein said reference resistor is attached externally.

3. The display device drive circuit according to claim 1, wherein said potential generating circuit outputs the output potential of said operational amplifier as said control potential.

4. The display device drive circuit according to claim 3, wherein a control terminal of one of said fourth transistors is connected to a second power supply line and control terminals of other of said fourth transistors have input thereto individual switching signals.

5. The display device drive circuit according to claim 4, wherein said signal generating circuit controls the number of said second transistors that are in an ON state so that the number per selected data line of said second transistors that are in an ON state is the same as a number of said fourth transistors that are in an ON state.

6. The display device drive circuit according to claim 1, wherein said display panel is a display panel that uses organic EL elements.

7. The display device drive circuit according to claim 1, wherein said display panel is a display panel that uses light-emitting diodes.

8. A display device drive circuit comprising:

first transistors, provided in parallel in a plurality for each data line in order to provide to the data lines of a display panel drive currents in accordance with a control potential;

second transistors provided for each of said first transistors in order to switch the drive currents for said data lines between a supplied state and a non-supplied state;

a potential generating circuit for supplying an identical control potential to said first transistors;

a signal generating circuit that controls a value of the drive currents supplied to said data lines by controlling a number of said second transistors that are in an ON state; and an electric current detector circuit which determines the number of said second transistors in an ON state using the control potential of said potential generating circuit, wherein said electric current detector circuit comprises a third transistor that outputs an electric current depending on the control potential of said potential generating circuit, a convertor resistor that converts the output current from said third transistor to a potential, a comparator that compares the potential obtained from said converter resistor to a reference potential, and a latch circuit that latches results of comparison by said comparator.

9. The display device drive circuit according to claim 8, wherein said third transistor is connected at one end to a first power supply line, is connected at an other end to one end of said converter resistor, and has input to a control terminal thereof the control potential of said potential generator circuit, an other end of said converter resistor is connected to a second power supply line, one input terminal of said comparator is connected to the one end of said converter resistor, and an other input terminal of said comparator is connected to said reference potential, and an input terminal of said latch circuit is connected to an output terminal of said comparator.

10. The display device drive circuit according to claim 8, wherein said electric current detector circuit comprises a plurality of said comparators and a different reference potential is input to each of said plurality of said comparators.

11. A display device drive circuit comprising:

a data line driver including driver circuits that respectively provide drive currents to respective data lines of a display panel, each of the driver circuits including a plurality of first transistors coupled together in parallel that each generate a first current responsive to a control signal, and a plurality of switching transistors that respectively provide the first currents to a driver output node as the drive current;

a potential generating circuit that supplies the control signal to said first transistors; and a signal generating circuit that controls values of the drive currents provided from the driver output nodes of the driver circuits to said data lines, by controlling a number of said switching transistors within the driver circuits that are in an ON state.

12. The display device drive circuit according to claim 11, wherein one end of each of said first transistors in a driver circuit is connected in common to a first power supply line, an other end of each of said first transistors in the driver circuit is connected to one end of a corresponding one of said switching transistors, and an other end of each of said switching transistors in the driver circuit is connected in common to the driver output node of the driver circuit.

13. The display device drive circuit according to claim 12, further comprising third transistors, provided for each of said data lines in order to discharge charge in said data lines.

14. The display device drive circuit according to claim 13, wherein one end of each of said third transistors is connected to said data lines, and an other end of each of said third transistors is connected to a second power supply line.

15. The display device drive circuit according to claim 11, wherein said signal generating circuit comprises:

a control circuit that generates data line select signals and scan line select signals for said display panel; and a switching signal generating circuit that controls the number of said switching transistors that are in the ON state responsive to an externally provided switching signal and said data line select signal.

16. The display device drive circuit according to claim 15, wherein only one of said switching transistors of a driver circuit has a data line select signal input to a control terminal thereof, whereas other of said switching transistors of the driver circuit have control signals from said switching signal generating circuit input to control terminals thereof.

17. The display device drive circuit according to claim 16, wherein said switching signal generating circuit generates said control signals using a logical sum of said switching signal and said data line select signal.

* * * * *